US011214896B2

(12) United States Patent
Sencopur

(10) Patent No.: US 11,214,896 B2
(45) Date of Patent: Jan. 4, 2022

(54) KNITTING YARN AND METHOD OF FORMING A KNITTED PRODUCT

(71) Applicant: YUNTEKS TEKSTIL SANAYI VE TICARET LIMITED SIRKETI, Isparta (TR)

(72) Inventor: Mehmet Abdullah Sencopur, Isparta (TR)

(73) Assignee: YUNTEKS TEKSTIL SANAYI VE TICARET LIMITED SIRKETI, Isparta (TR)

( * ) Notice: Subject to any disclaimer, the term of this patent is extended or adjusted under 35 U.S.C. 154(b) by 11 days.

(21) Appl. No.: 17/181,746

(22) Filed: Feb. 22, 2021

(65) Prior Publication Data

US 2021/0172100 A1 Jun. 10, 2021

Related U.S. Application Data

(63) Continuation of application No. 17/020,039, filed on Sep. 14, 2020, which is a continuation of application (Continued)

(30) Foreign Application Priority Data

| | | |
|---|---|---|
| Mar. 27, 2017 | (TR) | 2017/04579 |
| Jan. 31, 2019 | (TR) | 2019/01457 |
| May 2, 2019 | (TR) | 2019/06549 |

(51) Int. Cl.

| | |
|---|---|
| ***D04B 1/04*** | (2006.01) |
| *D02G 3/34* | (2006.01) |
| *D04B 1/22* | (2006.01) |

(52) U.S. Cl.
CPC ..... *D04B 1/04* (2013.01); *D02G 3/34* (2013.01); *D04B 1/22* (2013.01)

(58) Field of Classification Search
CPC ..... D04B 3/00; D04B 3/02; D04B 3/04; D04B 5/00; D04B 1/02; D04B 1/025; D04B 1/04; D04B 1/12; D02G 3/34
(Continued)

(56) References Cited

U.S. PATENT DOCUMENTS 167,563 A * 9/1875 Polle et al. ..... D04B 3/00 66/1 A
1,318,465 A 10/1919 Seifarth
(Continued)

FOREIGN PATENT DOCUMENTS

TR 200502097 6/2005

OTHER PUBLICATIONS

All About Finger Knitting, Simply Solutions, Aug. 2006.*
(Continued)

*Primary Examiner* — Danny Worrell
(74) *Attorney, Agent, or Firm* — Myers Wolin, LLC

(57) ABSTRACT

A knitting yarn used for forming a knitted product without using any knitting tools, such as crochet hooks or knitting needles. The knitting yarn includes a core thread having a length dimension and a plurality of loops affixed to the core thread, at least a first thread and at least a second thread having different structural and/or physical properties than each other; and the loops of the knitting yarn are made of the first thread, and the core thread is made of the second thread.

7 Claims, 4 Drawing Sheets

Related U.S. Application Data

No. 16/802,165, filed on Feb. 26, 2020, now Pat. No. 10,801,138, which is a continuation of application No. 16/515,071, filed on Jul. 18, 2019, now Pat. No. 10,793,980, which is a continuation-in-part of application No. 16/025,266, filed on Jul. 2, 2018, now Pat. No. 10,422,057, which is a continuation-in-part of application No. 15/726,781, filed on Oct. 6, 2017, now abandoned.

(58) Field of Classification Search
USPC ..... 66/1 A, 1 R, 3, 4
See application file for complete search history.

(56) References Cited

U.S. PATENT DOCUMENTS

| | | | | |
|---|---|---|---|---|
| 1,500,383 | A | 7/1924 | Gourie | |
| 1,532,810 | A | 4/1925 | Gourley | |
| 1,635,547 | A | 7/1927 | Gourie | |
| 1,691,527 | A | 11/1928 | Sakurai et al. | |
| 1,705,860 | A | 3/1929 | Hagihara | |
| 1,718,140 | A | 6/1929 | Hagihara | |
| 1,738,486 | A | 12/1929 | Wesseler | |
| 2,270,619 | A | 1/1942 | Fouts | |
| 2,382,614 | A | 8/1945 | De La Pena | |
| 2,609,676 | A | 9/1952 | Woroneski | |
| 2,803,051 | A | 8/1957 | Gutzmann | |
| 3,234,759 | A | 2/1966 | Larrasoain | |
| 3,458,988 | A | 8/1969 | Marshall | |
| 3,535,891 | A | 10/1970 | Corey | |
| 3,577,748 | A | 5/1971 | Nortland | |
| 3,868,834 | A | 3/1975 | Tichenor | |
| 4,196,573 | A | 4/1980 | Perry | |
| 4,351,148 | A | 9/1982 | Eschenbach | |
| 4,548,057 | A | 10/1985 | Essig | |
| 4,750,324 | A | 6/1988 | Tochacek et al. | |
| 4,845,960 | A | 7/1989 | Schnegg | |
| 5,669,244 | A * | 9/1997 | Okuno | D04B 1/22 66/64 |
| 7,147,009 | B1 * | 12/2006 | Murcar | D03D 23/00 139/33 |
| D648,942 | S | 11/2011 | Sencopur et al. | |
| 9,027,366 | B2 | 5/2015 | Raynor | |
| 9,334,589 | B2 | 5/2016 | Eddy | |
| 2003/0115912 | A1 * | 6/2003 | Okamoto | D04B 1/246 66/64 |
| 2009/0019614 | A1 | 1/2009 | Hagihara et al. | |
| 2010/0285431 | A1 | 11/2010 | Sencopur | |
| 2018/0274137 | A1 | 9/2018 | Sençopur | |
| 2018/0274138 | A1 | 9/2018 | Sençopur | |
| 2020/0347523 | A1 | 11/2020 | Sencopur | |

OTHER PUBLICATIONS

Ravelry: Loops&Threads Poodle. Web Page https://www.ravelry.com/yams/library/loops-threads-poodle, 2 pages, published Jul. 25, 2012.

Ravelry: SMC Select Dolce Vita. Web Page https://www.ravelry.com/yams/library/smc-select-dolce-vita, 3 pages, published Sep. 23, 2011.

Boutique Swerve Yam Red Heart. Web Page http://www.redheart.com/yarn/boutique-swerve, 4 pages, review published Feb. 25, 2016.

Loop Yam(raw white)—China Fancy Yam, Loop Yarn. Web page http://njyam.en.made-in-china.com:80/product/SoemtLaYawhf/China-Loop-Yarn-raw-white-.html. 2 pages, retrieved from Internet Archive Wayback Machine http://web.archive.org/web/20130302065923/http://njyam.en.made-in-china.com:80/product/SoemtLaYawhf/China-Loop-Yarn-raw-white-.html. showing captured publication date of Mar. 2, 2013.

Red Heart Boutique Swerve Review, Web Page http://www.youtube.com/watch?v=aC6PtGG0NzE, 8 pages, published Nov. 14, 2012.

Learn How to Make a Hand-Chain Scarf with Swerve yarn by Red Heart. Web Page http://www.youtube.com/watch?v=Z7SWeRhLh5s, 6 pages, published Apr. 10, 2012.

Lang Yarns Loop/Knitting Yam&Wool/LoveKnitting. Web page http://www.loveknitting.com/lang-yarns-loop, 4 pages, retrieved on Jul. 24, 2018.

Fashion Loop Yarn/Schachenmayer SMC Knitting Yarns/KnitUK, Web page http://www.knituk.com/ourshop/prod_2705103-SMC-Select-Fashion-Loop-100g-Schachenmayr-super-chunky-texture-wool-yarn.html. 14 pages 2012-2018.

How to Crochet a Scarf:Swerve Scarf in 1 Minute. Web Page http://www.youtube.com/watch?v=QQYMAXgd2FA, 4 pages, published Dec. 27, 2013.

Ravelry:SuzieKnits2's Dolce Vita loopy scarf. Web page http://www.ravelry.com/projects/SuzieKnits2/dolce-vita-loopy scarf, 2 pages, published Dec. 2, 2011.

Ravelry:HCY's Dolce Vita scarf, Web Page http://www.ravelry.com/projects/HCY/dolce-vita-scarf, 2 pages, published Sep. 4, 2011.

Ravelry:Bowmanville's Thrummed playground mitts. Web page http://www.ravelry.com/projects/BOWMANVILLE/playground-mittens-2, 2 pages, published Jan. 11, 2014.

Ravelry:Bowmanville's thrummed mitts. Web page http://www.ravelry.com/projects/BOWMANVILLE/105-family-thrummed-mittens, 2 pages, published Feb. 13, 2013.

Ravelry:AndyLyn's Dolce Vita scarf, Web page http://www.ravelry.com/projects/AndyLyn/dolce-vita-scarf,2 pages, published Sep. 30, 2011.

Y.E.El Mogahzy, Integrating the Design and Manufacture of Textile Products, (2009) Woodhead Publishing Series in Textiles, Chapter 9.3.3, pp. 255-258. (Year:2009).

Heart Read. Red Heart and You. TM Two Hearts One Passion. Catalog 2012/2013, Dec. 31, 2012, retrieved from the Internet: URL:http://www.redheart.de/files/Red_HeartYarns_Catalog_2012.pdf, p. 40-41.

Non-final Office Action issued by the USPTO for corresponding family U.S. Appl. No. 16/515,071, dated May 14, 2020.

Phillips et al., "Kids Can Make It.com," Arts & Crafts—Finger Knitting, pp. 1-2, retrieved from the Internet URL: <http://www.kidscanmakeit.com/AC0023.htm>, Kids Can Make It, Inc., Dec. 7, 2002.

Non Final Office Action issued for corresponding U.S. Appl. No. 16/802,165, dated May 14, 2020.

* cited by examiner

KNITTING YARN AND METHOD OF FORMING A KNITTED PRODUCT

CROSS REFERENCE TO THE RELATED APPLICATIONS

This application is a continuation of U.S. patent application Ser. No. 17/020,039, filed Sep. 14, 2020, which is a continuation of U.S. patent application Ser. No. 16/802,165, filed Feb. 26, 2020, now U.S. Pat. No. 10,801,138, issued on Oct. 13, 2020, which is a continuation of U.S. patent application Ser. No. 16/515,071, filed Jul. 18, 2019, now U.S. Pat. No. 10,793,980, issued on Oct. 6, 2020, which is a continuation-in-part application of U.S. patent application Ser. No. 16/025,266 filed on Jul. 2, 2018, now U.S. Pat. No. 10,422,057, issued Sep. 24, 2019. U.S. patent application Ser. No. 16/515,071, filed Jul. 18, 2019, also claims priority from Turkish Patent Application No. 2019/06549 filed on May 2, 2019, which is continuation-in-part application of Turkish Patent Application No. 2019/01457 entered into Turkey on Jan. 31, 2019 as a national phase application of International Application No. PCT/TR2017/000096 filed on Aug. 17, 2017, which claims priority from Turkish Patent Application No. 2017/04579 filed on Mar. 27, 2017. U.S. patent application Ser. No. 16/025,266 filed on Jul. 2, 2018 is continuation-in-part application of U.S. patent application Ser. No. 15/726,781 filed on Oct. 6, 2017, which claims priority from Turkish Patent Application No. 2017/04579 filed on Mar. 27, 2017. The contents of each of these applications is incorporated herein by reference.

TECHNICAL FIELD

The present invention relates to a knitting yarn which is used for forming knitted products by hand-knitting without using any knitting tools, such as crochet hooks, knitting needles etc., as well as a method for forming knitted products by using said yarn.

BACKGROUND

Currently, knitting apparatuses/tools such as crochet hooks or knitting needles are required when knitting, i.e. hand-knitting, is carried out with the traditional yarns. It is quite difficult for a person without experience or skill in knitting to perform a knitting procedure by using conventional yarns, since it requires one to know the specifics of knitting, including the use of such tools. Furthermore, even if such a person would have experience and skill in hand-knitting, it is still not possible for such a person to knit large items in a short period of time by using conventional yarns.

U.S. Pat. No. 1,705,860 discloses a knitting tool. After a conventional knitting yarn, i.e. without having any loops thereon) is properly threaded about a plurality of pins arranged on the knitting tool, said yarn initially forms loops and then once the yarn is threaded through said loops by means of a knitting apparatus such as a crochet hook or a knitting needle, new loops are formed and accordingly the knitting is performed on said knitting tool by using the knitting apparatuses. With the new loops formed, the knitting procedure is performed on the pins. However, as shown in the drawings of U.S. Pat. No. 1,705,860, it is highly complicated to initially form the loops on the pins of the tool disclosed in the patent and then to perform the knitting procedure again using the pins and the knitting apparatuses. Furthermore, in the knitting procedure disclosed therein, it is a disadvantage for a user to necessarily use the knitting tool.

On the other hand, it is obvious that said document is silent about a yarn having pre-formed loops and accordingly a knitting method that is carried out by using such a yarn.

As a kind of the conventional yarns present in the prior art, there are available yarns having ring-like elements similar to the loops of the yarn disclosed in the present invention, which are formed by folding a uniform yarn on itself. However, said yarns are knitted by means of conventional knitting methods using crochet hooks and/or knitting needles, and the ring-like elements on the yarn are not taken into consideration in the knitting procedure, and also it is aimed to cause the ring-like elements to appear on the product as a pattern when the knitted product is formed. On the other hand, if the yarns are inspected, it is apparent that said ring-like elements cannot be considered as a loop since they do not have a proper ring array on the yarn, and accordingly, it is not possible to knit them by means of the knitting method disclosed in the present invention.

Thanks to the knitting yarn having pre-formed loops and exhibiting a form that can be knitted without using any knitting tools such as crochet hooks and/or knitting needles according to the present invention, a user may carry out the knitting procedure in an easy manner by means of the loops present on the yarn. Due to the fact that no knitting tools is needed in the knitting method performed by using the yarn of the present invention, a cost-effective knitting method is provided for the user/hand-knitter. Said knitting method according to the invention is performed by threading the loops present on the knitting yarn through each other's interior space in a suitable form and order.

In a preferred embodiment of the invention, the knitting yarn with loops is formed by combining at least two different threads. The loops of the yarn thus formed are preferably formed by at least a first thread, and a core section of said thread is formed by at least a second thread, which has different structural and/or physical properties when compared with the first thread. When the yarn of the present invention is knitted according to the knitting method of the present invention, one surface of the formed knitted product exhibits the properties of the first thread while other surface exhibits the properties of the second thread.

SUMMARY

Primary object of the invention is to provide a knitting yarn having pre-formed loops thereon, by means of which a knitting process is performed in an easy manner and which may be knitted without requiring an additional tool.

Another object of the invention is to provide a knitting method in which the knitting yarn having pre-formed loops may be knitted in an easy manner and without requiring an additional tool.

Another object of the invention is to provide a knitting yarn formed by combining at least two threads having different properties, in a proper manner.

Still another object of the invention is to provide a knitting method for forming a knitted product having a surface with the properties of the first thread and another surface with the properties of the second thread.

The present invention describes a knitting yarn used for forming a knitted product without using any knitting tools, such as crochet hooks, knitting needles etc. The knitting yarn comprises a core thread having a length dimension and a plurality of loops affixed to the core thread wherein the knitting yarn comprises at least a first thread and at least a second thread having different structural and/or physical properties than each other; and the loops of the knitting yarn are made of the first thread, and the core thread is made of the second thread. The present invention also describes a knitting method of forming a knitted product by knitting the knitting yarn of the present invention. Said method comprises the steps of: a) arranging the knitting yarn into a plurality of rows; b) threading at least one loop of an arranged second row through an interior space of at least one corresponding loop of an arranged first row; c) applying threading step (b) to all of the loops of the first row and second row; d) threading each of the loops of an upper row yet-to-be-knitted through an interior space of each of the loops obtained by previous threading step; (e) repeating step (d) till a knitted product is formed.

BRIEF DESCRIPTION OF THE DRAWINGS

The knitting yarn and corresponding knitting method according to the invention are illustrated in the accompanying drawings for providing a better understanding of the present invention and are as such not intended to be used in the interpretation of the claims in the absence of the present description, and as restricting the invention.

Figure 1:
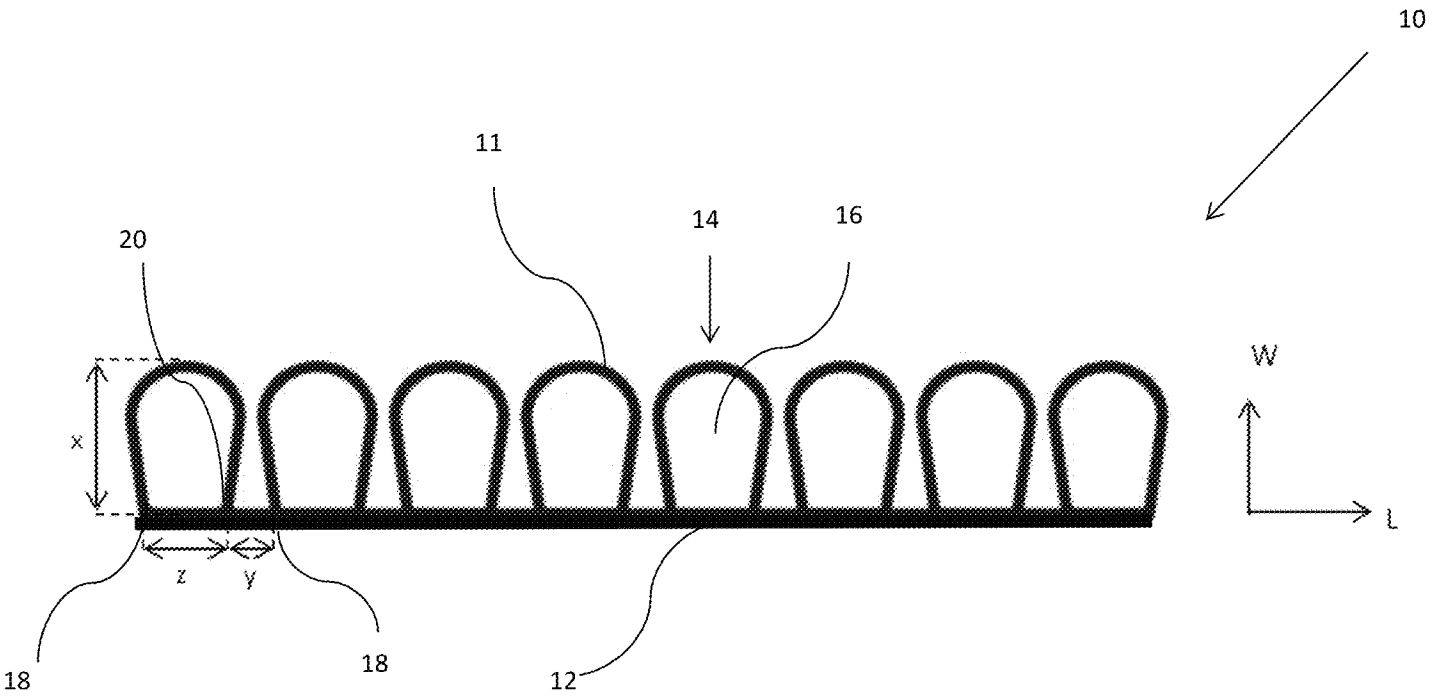
FIG. 1 is a side elevational view of a knitting yarn having loops according to the present invention.

10. knitting yarn
11. first thread
12. second thread
14. loop
16. interior space
18. first end of loop
20. second end of loop
22. first row
24. second row
26. upper row
28. loop of final row
30. binding loop
32. first surface (of knitted product)
66. knitted product

DETAILED DESCRIPTION OF THE EMBODIMENTS

Figure 2:
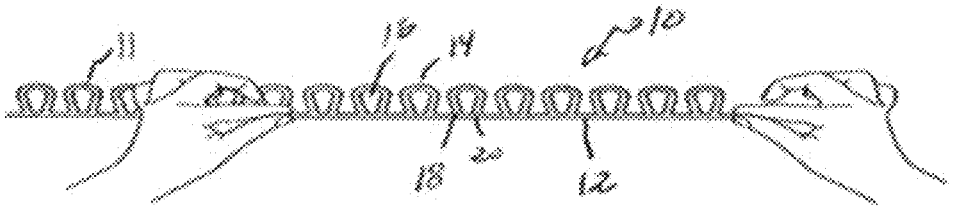
FIG. 2 is an illustration showing the step of arranging the knitting yarn into a plurality of rows in accordance with the method according to the present invention.
Figure 3:
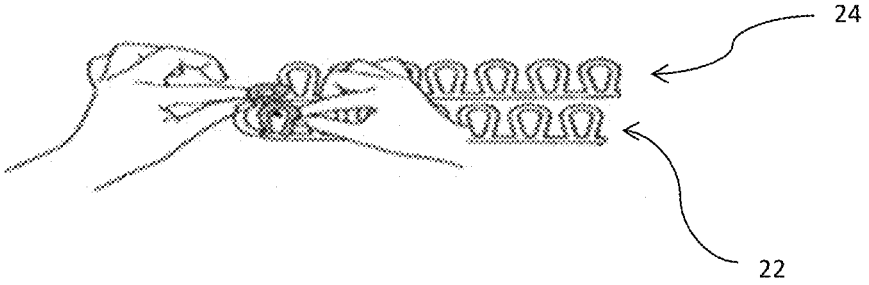
FIG. 3 is an illustration showing the step of threading a loop of the second row through an interior space of a corresponding loop of the first row in accordance with the method according to the present invention.
Figure 4:
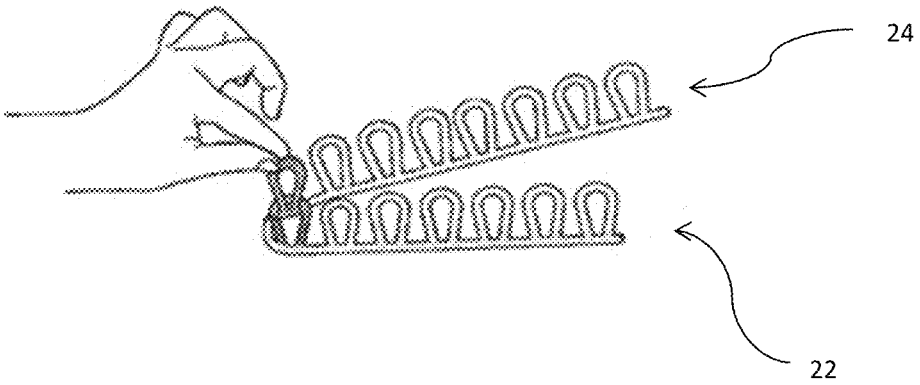
FIG. 4 is an illustration wherein a loop of the second row is being threaded through an interior space of a corresponding loop of the first row in accordance with the method according to the present invention.

The present invention describes a knitting yarn (10) comprising a core thread having a length dimension and a plurality of loops (14) affixed to the core thread. Said knitting yarn (10) ensures that one may carry out a hand-knitting procedure and thus form hand-knitted products (66) without using any knitting tool such as crochet hooks, knitting needles or etc., as shown in FIGS. 2 to 4. With the loops (14) available on the knitting yarn (10), a knitting procedure may be carried out in an easy manner.

Said knitting yarn (10) is formed by combining at least two threads in a proper manner. In a preferred embodiment of the invention, said knitting yarn (10) is formed by combining at least a first thread (11) and at least a second thread (12). The loops (14) of the inventive knitting yarn (10), as illustrated in FIG. 1, are made from the first thread (11), and the core forming the main body of the yarn is made from the second thread (12). In general terms, the loops (14) of the knitting yarn (10) extend in direction (W) and the core extends in direction (L). Said first thread (11) and second thread (12) are preferably different from each other in terms of their structural and/or physical properties. Such difference of the first thread (11) and the second thread (12) may result from the fact that the raw materials thereof have different nature/structural properties from each other, or may result from the fact that said threads are selected to have different physical properties, such as color. For example, one of the threads may be cotton while the other one may be selected from different types of threads such as wool, polyester, linen, nylon, or a combination thereof. On the other hand, said threads may have different color combinations or different thicknesses. One or more of the threads may have a flexible/elastic structure whereas the other may not be capable of stretching. The threads may independently have a silvery, boucle, chenille and/or hairy structure, and also may be dyed by different dying techniques. Each of the examples mentioned here may be applied individually to the knitting yarn (10) according to the invention, or may be applied in different combinations depending on the request or need.

Each of the plurality of loops (14) disclosed in the present invention defines an interior space (16) adapted to receive another loop, i.e. for threading any other loop there through. Furthermore, according to a preferred embodiment of the invention, each of the plurality of loops (14) comprises a first end (18) and a second end (20), both affixed to the second thread (12). The first end (18) and the second end (20) of each of the loops (14) positioned on the second thread (12) may be positioned at the same location, or spaced from each other at a predetermined distance (z), on the second thread (12), as shown in FIG. 1. Optionally, said distance (z) may be varied in a predetermined manner in terms of the loops of a knitting yarn (10). The locations where the first end (18) and the second end (20) of each loop (14) are affixed to the second thread (12) with respect to each other affect the surface appearance of the knitted product (66) that is obtained once the knitting yarn (10) according to the invention is knitted by the method disclosed below.

In an embodiment of the invention, the second end (20) of one of the two successive loops and the first end (18) of the other of said two successive loops, wherein said second end (20) is adjacent to said first end (18), may be positioned so as to be in the same location on the second thread (12), or they may be in spaced relation to each other with a predetermined distance (y), as shown in FIG. 1. The locations where the second end (20) of one of the two successive loops (14) and the first end (18) of the other are affixed to the second thread (12) is effective in adjusting the yarn density of the knitted product (66) obtained by knitting the knitting yarn (10) according to the method disclosed below. In applications in which a knitting yarn (10) having a short distance (y) is knitted, the yarn density of the knitted product (66) in direction (L) is high, whereas in applications in which a knitting yarn (10) having a relatively long distance (y) is knitted, the yarn density in direction (L) is relatively low. Optionally, said distance (y) may be varied in a predetermined manner in terms of the loops of a knitting yarn (10).

In an embodiment of the invention, each of the loops (14) formed of the first thread (11) has a predetermined length (x) extending in direction (W). Said length (x) is effective in adjusting the yarn density of the knitted product (66) that is obtained by knitting the knitting yarn (10) according to the invention by the method disclosed below. In applications in which a knitting yarn (10) having a short length (x) is knitted, the yarn density of the knitted product (66) in direction (W) is high, whereas in applications in which a knitting yarn (10) having a relatively long length (x) is knitted, the yarn density in direction (W) is relatively low. Optionally, said length (x) may be varied in a predetermined manner in terms of the loops of a knitting yarn (10).

The knitting yarn (10) according to the present invention embodying one or more of the embodiments disclosed above is knitted without using any knitting tool such as crochet hooks, knitting needles or etc., in order to obtain knitted products (66).

Figure 5:
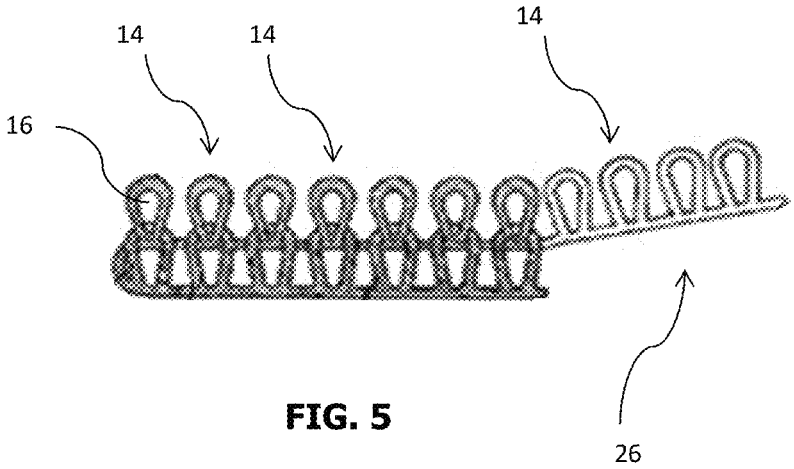
FIG. 5 is an illustration wherein all the loops of the second row are being threaded through an interior space of the loops of the first row in accordance with the method according to the present invention.
Figure 6:
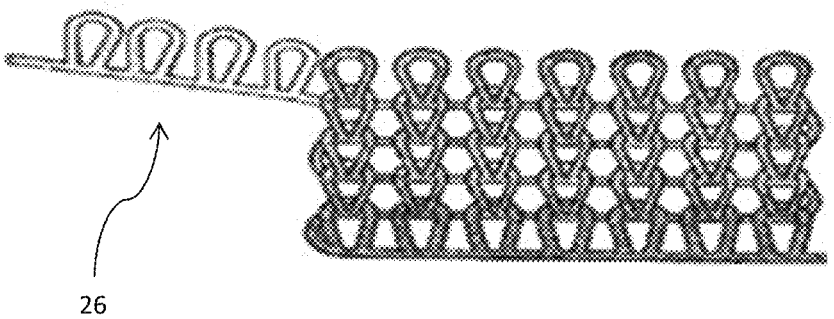
FIG. 6 is an illustration of a knitted product knitted by the method according to the present invention.

A method for knitting a knitting yarn (10) according to the present invention comprises the steps of:

a) arranging the knitting yarn (10) into a plurality of rows, each of which includes a desired number of loops (14), as shown in FIG. 2;

b) threading at least one loop (14) of an arranged second row (24) through an interior space (16) of at least one corresponding loop (14) of an arranged first row (22), as shown in FIGS. 3 and 4;

c) applying threading step (b) to all of the loops (14) of the first row (22) and second row (24) (FIG. 5);

(d) threading each of the loops (14) of an upper row (26) yet-to-be-knitted, as shown in FIGS. 5 and 6, through an interior space (16) of each of the loops (14) obtained by the previous step;

(e) repeating step (d) till a knitted product (66) is obtained.

Figure 7:
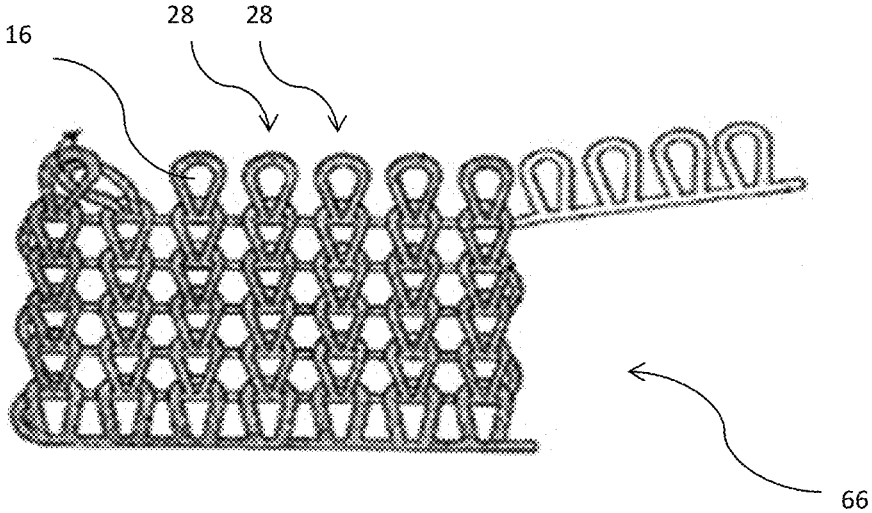
FIG. 7 is an illustration showing the step of inserting a second loop adjacent to the first loop of final row through an interior space of the first loop in accordance with the method according to the present invention.
Figure 8:
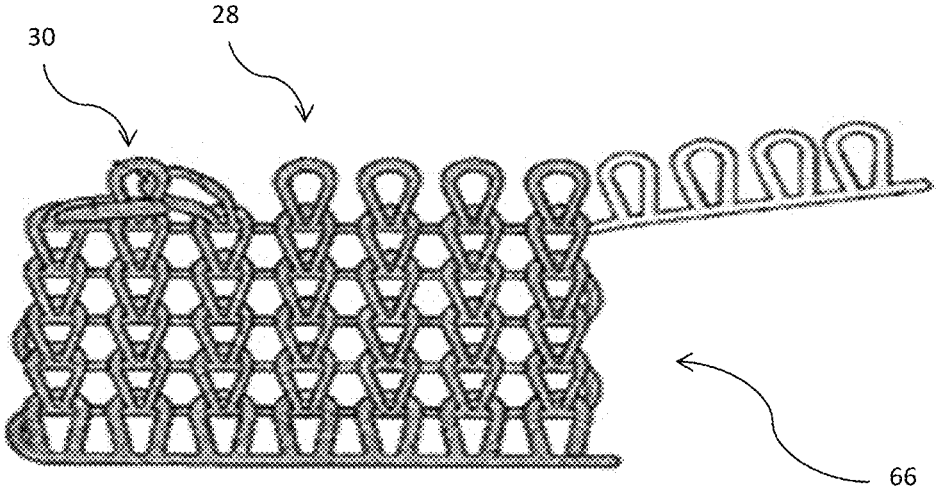
FIGS. 8 and 9 are illustrations showing the step of inserting another loop adjacent to the binding loop through an interior space of the latter, following the process step shown in FIG. 7, in accordance with the method according to the present invention.
Figure 9:
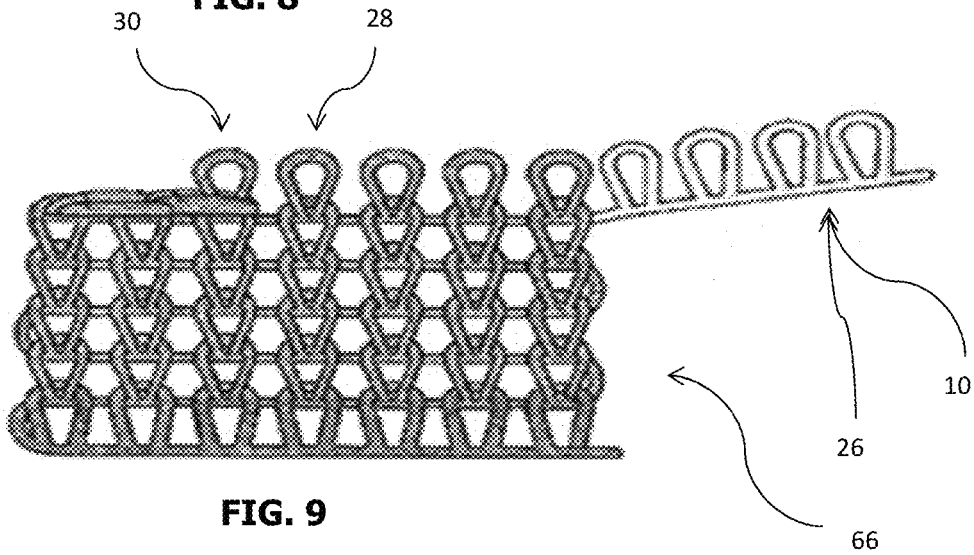

Once the knitting yarn (10) according to the present invention is knitted in accordance with the above-described method (steps (a-e)), the knitted product (66) in desired dimension is obtained, the knitting steps are terminated and optionally a binding step is carried out on said knitted product (65). Accordingly, loops of a final row (28), which were obtained on the knitted product (66) by the previous threading step, are associated with each other for binding the loops of said final row (28) once the knitted product (66) is formed after step e). Thus, the loops of said final row (28) are incorporated into structure of the knitted product (66). In a preferred embodiment of the invention, said binding off is performed by inserting a first loop of the final row (28) through an interior space (16) of a loop (28) adjacent thereto for obtaining a binding loop (30); then inserting the obtained binding loop (30) through an interior space (16) of other loop (28) adjacent to the obtained binding loop (30); and applying said inserting step respectively to the other loops of the final row (28) in order to bind off the loops of the final row (28) which were obtained by the previous threading step, once the knitted product (66) is formed after step e). In another preferred embodiment of the invention, said binding off is performed by inserting a second loop (28) adjacent to the first loop (28) of the final row (28) through an interior space (16) of the first loop of the final row (28) and obtaining a binding loop (30); then inserting another adjacent loop (28) through an interior space (16) of the obtaining a binding loop (30), and applying said inserting step respectively to the other loops (28) of the final row (FIGS. 7, 8 and 9), in order to bind off the loops of the final row (28).

Figure 10:
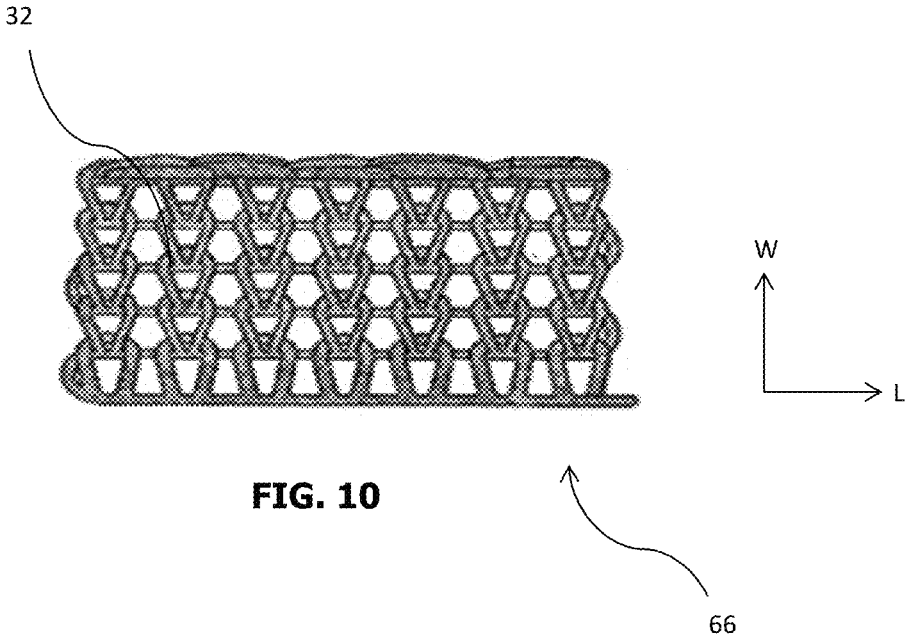
FIG. 10 is an illustration of a knitted product that has been knitted by the method according to the present invention, with all the loops of the final row being bound-off. All the components in the drawings are individually numbered as follows.

After all loops of the final row (28) obtained on the knitted product (66) by the previous threading steps are associated with each other and thus, after they all incorporated into structure of the knitted product (66); a final binding loop (30), that is obtained at the end of the above disclosed inserting (binding) steps and that is knitted but not bound-off yet, will be present. The upper row (26) of the knitting yarn (10) yet-to-be-knitted is inserted through an interior space (16) of said final binding loop (30) for incorporating said final binding loop (30) into the structure of the knitted product (66) and finalizing the knitting process, i.e., both threading and binding steps (FIG. 10).

A first surface (32) of the knitted product (66) that is obtained by knitting the knitting yarn (10) of the present invention according to the method steps disclosed herein has the properties of the first thread (11), while the back surface thereof (not shown) has the properties of the second thread (12). In fact, with the knitting method according to the present invention, the loops formed of the first thread (11) form the first surface (32) of the knitted product (66), and the core section thereof formed by the second thread (12) mainly forms the back surface of the knitted product (66). Accordingly, since the first thread (11) and the second thread (12) have different properties, it is ensured that the structural and/or physical properties of the front and back surfaces of the knitted product (66) obtained by knitting the yarn (10) of the present invention by means of the above-described method will also be different. In this manner, both surfaces of the resulting knitted product (66) which may be considered and called as the front and back surfaces may indeed be used as the front surface. In other words, the knitted product (66) does not have a back surface however; it comprises two surfaces which are both suitable to be used as a front surface. In this manner, it is possible to obtain knitted products which have a surface made of a raw material that is suitable for using in hot weather conditions, such as cotton, and another surface made of a material that is suitable for using in cold weather conditions, such as wool. Similar examples can be expanded on the basis of the desire and requirements for obtaining a knitted product i.e.; with surfaces having different colors, with one surface slippery and the other surface is not slippery, or one surface is hairy and the other one is not hairy.

The knitting yarn (10) and knitting method according to the present invention is advantageous in that it allows manufacturing of knitted products (66) having surfaces with different characters, colors and/or properties.

According to an embodiment of the present invention, the loops (14) on the knitting yarn (10) are all dyed in same color. According to another embodiment of the present invention, said loops (14) are dyed in different colors. In another embodiment, said loops (14) are dyed to have alternating color arrays. On the other hand, one or more loops (14) may be grouped, and each group may be dyed in the desired colors or color combinations. In this manner, it is ensured that the knitted products (66) obtained by using the knitting method as described above have predetermined patterns or color combinations.

According to an embodiment of the present invention, said first thread (11) and/or the second thread (12) have a flexible/elastic structure. This may be ensured in that the fiber structure of the first thread (11) and/or the second thread (12) are made of flexible raw materials. The fact that the first thread (11) and/or the second thread (12) forming the loops/core thread have an elastic structure facilitates the work of the knitter in the knitting process and especially in threading a loop (14) through an interior space of the other loop (14). Additionally, the knitted product (66) obtained by using the above-described knitting method also has an elastic structure.

With the present invention, a person with no experience in knitting may perform the knitting process in an easy manner by simply using the knitting yarn (10) according to the invention without the use of any tools, such as crochet hooks or knitting needles. On the other hand, the loops (14) of the knitting yarn (10) may have relatively large dimensions (x, y and z) so as to be knitted manually. Accordingly, even large knitted products (66) may be knitted in a short period of time.

According to an embodiment of the invention, the knitting yarn (10) according to the present invention may be manufactured in fancy yarn machines.

The knitting tools disclosed in this text means any tools used in knitting such as crochet hooks, knitting needles, circular needles or stitch holders. However, it does not include knitting yarn according to the present invention.

What is claimed is:

1. A method for forming a knitted product from knitting yarn having a plurality of pre-arranged loops, comprising:

a) arranging the knitting yarn into a first row;

b) threading, by hand and without knitting tools, at least one loop of the knitting yarn of a row yet-to-be-knitted through an interior space of at least one corresponding loop of the first row;

c) applying threading step (b) to all loops of the first row to form a knitted row; and d) repeating steps (b) and (c) to form a knitted product of successively knitted rows by hand and without knitting tools.

2. The knitting method according to claim 1, further comprising associating loops of a final row with each other, wherein, the loops of the final row are obtained by the previous threading step, for binding the loops of the final row once the knitted product is formed.

3. The knitting method according to claim 2, further comprising inserting a first loop of the final row through an interior space of a loop adjacent thereto for obtaining a binding loop; inserting the obtained binding loop through an interior space of other loop adjacent to the obtained binding loop; and applying the inserting step respectively to other loops of the final row, in order to bind off the loops of the final row obtained by the previous threading step, once the knitted product is formed.

4. The knitting method according to claim 2, further comprising inserting a second loop adjacent to a first loop of the final row through an interior space of the first loop of the final row and obtaining a binding loop, inserting another adjacent loop through an interior space of the obtained binding loop, and applying the inserting step respectively to other loops of the final row, in order to bind off the loops of the final row obtained by the previous threading step, once the knitted product is formed.

5. The knitting method according to claim 3, further comprising inserting an upper row of the knitting yarn yet-to-be-knitted through an interior space of a final binding loop, wherein the final binding loop is knitted but not bound-off yet, in order to bind off the final binding loop of the final row.

6. The knitting method according claim 4, further comprising inserting an upper row of the knitting yarn yet-to-be-knitted through an interior space of a final binding loop, wherein the final binding loop is knitted but not bound-off yet, in order to bind off the final binding loop of the final row.

7. A knitted product formed by the method of claim 1.

* * * * *